US006503385B2

(12) United States Patent
Chorzempa

(10) Patent No.: US 6,503,385 B2
(45) Date of Patent: Jan. 7, 2003

(54) METHOD AND APPARATUS FOR GROWTH REMOVAL IN AN ELECTROWINNING PROCESS

(75) Inventor: Robert Chorzempa, Demotte, IN (US)

(73) Assignee: Metals Investment Trust Limited, London (GB)

( * ) Notice: Subject to any disclaimer, the term of this patent is extended or adjusted under 35 U.S.C. 154(b) by 0 days.

(21) Appl. No.: 09/805,228

(22) Filed: Mar. 13, 2001

(65) Prior Publication Data

US 2002/0130038 A1 Sep. 19, 2002

(51) Int. Cl.[7] ..... C25C 7/08; C25C 1/16; C25C 7/00; C25D 17/00

(52) U.S. Cl. ..... 205/350; 205/602; 204/227; 204/267; 204/222

(58) Field of Search ..... 204/227, 281, 204/267, 222; 205/350, 602

(56) References Cited

U.S. PATENT DOCUMENTS

| | | | | |
|---|---|---|---|---|
| 4,100,042 A | | 7/1978 | Wojcik et al. | 204/105 R |
| 4,668,369 A | * | 5/1987 | King | 204/227 |
| 4,715,934 A | | 12/1987 | Tamminen | 204/10 |
| 5,565,083 A | * | 10/1996 | Yarchi et al. | 205/602 |

* cited by examiner

*Primary Examiner*—Nam Nguyen
*Assistant Examiner*—Thomas H. Parsons
(74) *Attorney, Agent, or Firm*—Akerman Senterfitt

(57) ABSTRACT

An electrolytic cell (10) comprises a plurality of cathodes (12) interspersed among a plurality of anodes (16). The plurality of cathodes and plurality of anodes form a plurality of electrodes spaced and suspended in parallel fashion in an electrolyte solution (35). The electrolytic cell further comprises a plurality of scrapers (14). Each scraper of the plurality of scrapers is placed between each of the plurality of electrodes in parallel fashion and the scraper moves a minimal distance relative to the plurality of electrodes.

15 Claims, 3 Drawing Sheets

METHOD AND APPARATUS FOR GROWTH REMOVAL IN AN ELECTROWINNING PROCESS

CROSS REFERENCE TO RELATED APPLICATIONS (not applicable)

BACKGROUND OF THE INVENTION

1. Field of the Invention

The instant invention pertains generally to the field of electrowinning. More particularly, the invention describes a method and apparatus for removing growth such as dendrite growth from electrodes during the electrowinning process.

2. Description of Related Art

There are many instances where metal is dissolved in a solution and it is desired to reclaim the metal from the solution. In the process of electrowinning metals from solutions, metals from a solution in an electrolytic or electrochemical cell grow dendrites or mossy growth of metal layers resulting in porous and uneven deposits that span the interelectrode gap. In other words, dendrites typically grow very rapidly from cathode to anode causing a short circuit of the cell. Various techniques have been used to overcome this problem including the use of centrifugal motion of a cathode within electrolyte to cause the dendrite growth to fall off as shown in U.S. Pat. No. 4,715,934 by Pentti Tamminen. In another technique, posts used in a reciprocating agitator cause a high velocity flow of slurry between the posts and electrode causing a scrubbing action as shown in U.S. Pat. No. 4,100,042 by Wojcik, et al. Although these methods are effective in removing dendrite growth, they require many moving parts or require significant maintenance. Additionally, some of these techniques are not suitable for electrolytic cells that have fairly narrow gaps or that have a significant number of electrodes.

SUMMARY OF THE INVENTION

In a first aspect of the present invention, a method of removing growth from an electrode during an electrowinning process includes the steps of placing a scraper between a first electrode and a second electrode of opposing polarity and moving the scraper a minimal distance relative to the electrodes.

In another aspect of the present invention, an electrolytic cell has a plurality of electrodes of opposing polarity and a scraper placed between each of the plurality of electrodes of opposing polarity. The scraper is arranged to move a minimal distance relative to the plurality of electrodes.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE INVENTION

Figure 1:
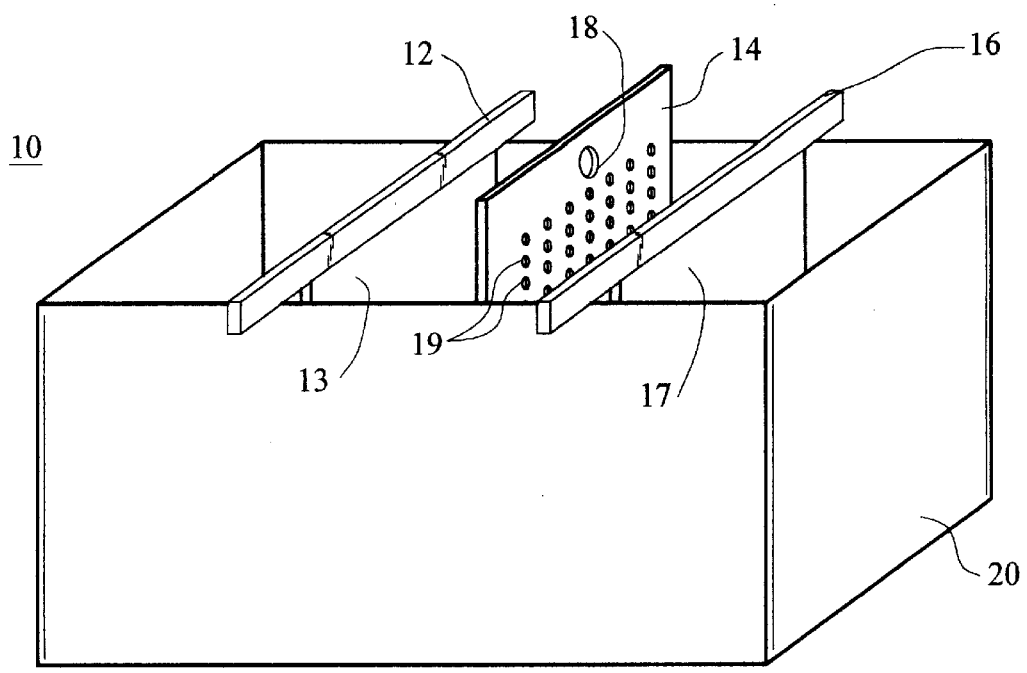
FIG. 1 is a perspective view of a portion of a cell box containing electrodes and a scraper in accordance with the present invention.
Figure 2:
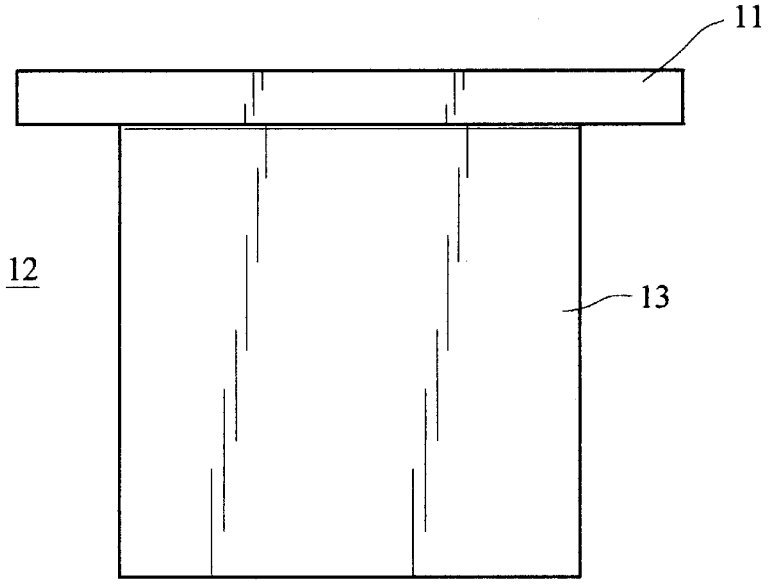
FIG. 2 is a front plan view of an electrode in accordance with the present invention.
Figure 3:
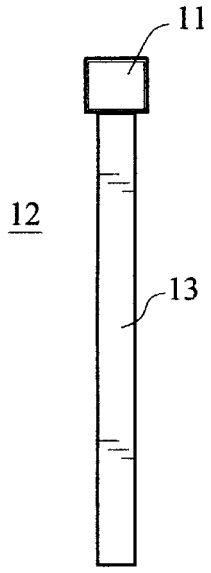
FIG. 3 is a side view of the electrode of FIG. 2 in accordance with the present invention.

Referring to FIG. 1, a perspective view of a portion of an electrolytic or electrochemical cell 10 is shown. The cell 10 preferably comprises a box or tank where the electrowinning process takes place and a plurality of electrodes such as cathode 12 and anode 16. Although the present example will be described with reference to the process of plating zinc from solution as commonly used in the process of recycling galvanized metal, it should be understood that the present invention is applicable to the process of electrowinning in general for most metals. The cell 10 also preferably comprises a scraper 14 that is preferably placed between each electrode in the cell 10. Referring to FIGS. 1–5, the electrodes and scraper are described in further detail. Each electrode, such as cathode 12 preferably comprises a handle 11 for use in suspending the electrode in electrolyte within the cell 10. The remainder of the electrode is a conductive portion that carries current to the electrolyte solution. FIG. 2 shows a front plan view and FIG. 3 shows a side view of the cathode 12. In the case of the cathode 12, the conductive portion 13 is the part of the electrode that zinc would plate onto. In the case of anode 16, the conductive portion 17 serves to complete the circuit of the cell.

Figure 4:
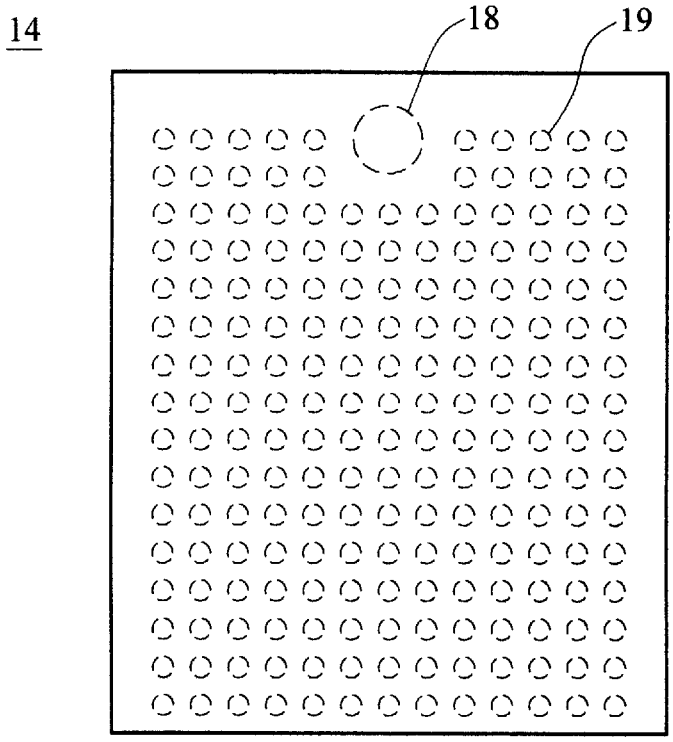
FIG. 4 is a front plan view of a scraper in accordance with the present invention.
Figure 5:
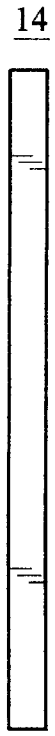
FIG. 5 is a side view of the scraper of FIG. 4 in accordance with the present invention.

The scraper 14 preferably has a surface area that is larger than the surface area of the conductive portions (13 or 17) of the electrodes. FIG. 4 shows a front plan view and FIG. 5 shows a side view of the scraper 14. The scraper 14 optionally includes a plurality of holes 19 to allow adequate flow of metal laden electrolyte between the electrodes. The scraper may also optionally include a larger hole 18 for extending a drive shaft through the hole as will be clearly understood with reference to FIG. 6.

Figure 6:
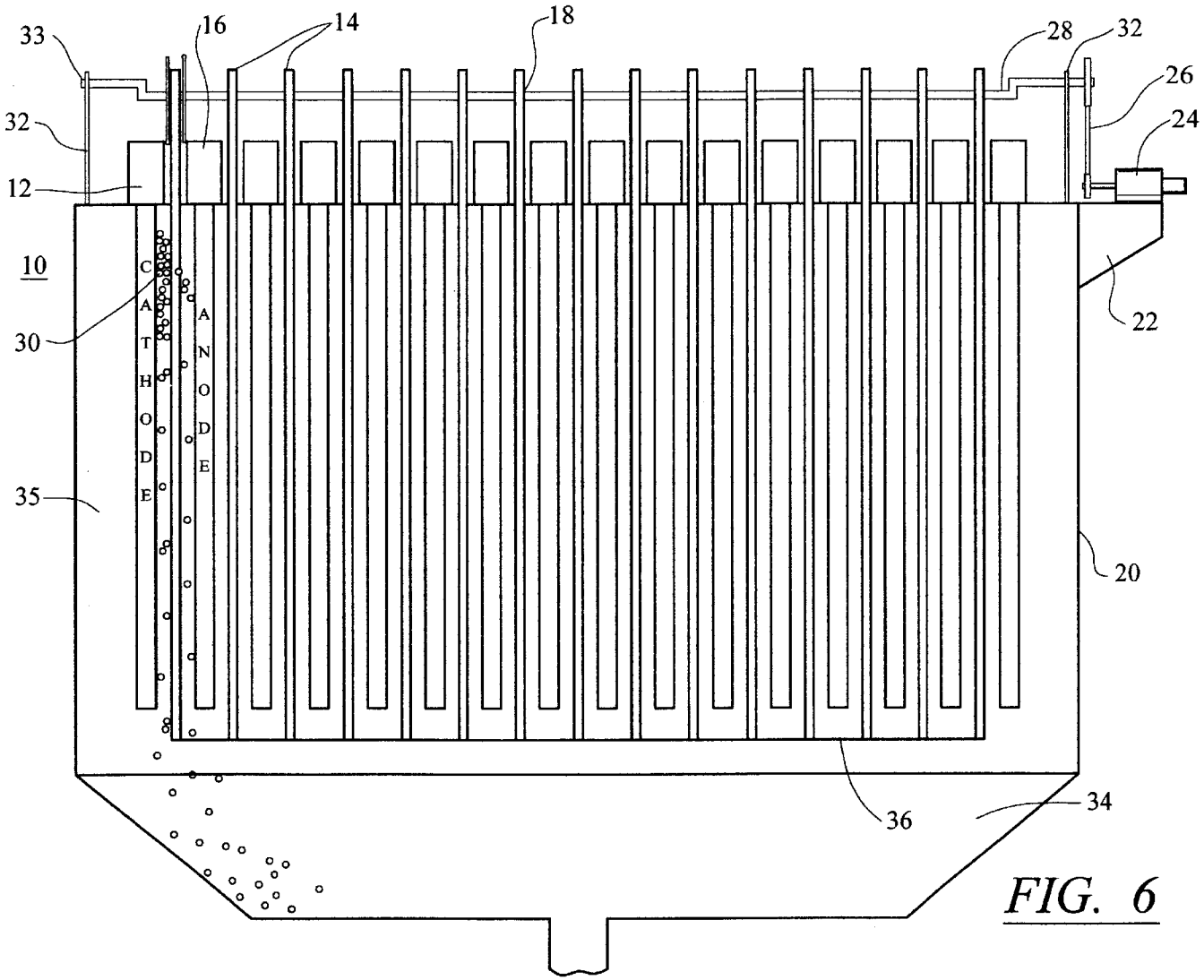
FIG. 6 is a side cut view of a cell box showing the electrodes and a scraper that moves relative to the electrodes to remove growth in accordance with the present invention.

Once again, FIG. 6 illustrates an electrolytic or electrochemical cell 10 in accordance with the present invention. The cell 10 preferably comprises a plurality of cathodes 12 interspersed among a plurality of anodes 16 within a box or tank 20. The plurality of cathodes 12 and plurality of anodes 16 form a plurality of electrodes spaced and suspended in parallel fashion in an electrolyte solution 35. The cell 10 preferably comprises a plurality of scrapers 14 made of non-conductive material such as polypropylene. Each scraper 14 of the plurality of scrapers is preferably placed between each of the plurality of electrodes in parallel fashion. The scraper 14 is preferably arranged and constructed to move a minimal distance relative to the plurality of electrodes. The plurality of scrapers are preferably coupled together using at least one thin strip 36 of polypropylene or some other non-conductive material to ensure that the scrapers remain parallel to the electrodes and move as a group. Ideally, the scrapers are tied together using one thin strip for each bottom corner for a total of two thin strips of polypropylene. The scraper preferably has a larger surface area than the surface area of one of the plurality of electrodes so that the scraper extends beyond the edges of one of the plurality of electrodes. This is particularly advantageous since dendrite growth 30 tends to be the greatest at the edges of the electrodes.

In one embodiment of the present invention as shown in FIG. 6, the scraper 14 or plurality of scrapers is made to move relative to the electrodes by moving an eccentric shaft 28 coupled through holes 33 in posts 32 at opposing ends of the cell 10 and coupled through holes 18 in the respective scrapers 14. A motor 24 preferably drives the eccentric shaft 28 via drive belt 26 as shown. Preferably, the motor 24 is a variable speed drive motor. The movement of the eccentric shaft preferably moves the plurality of scrapers only a minimal distance. For example, it may move the scraper 14 around half an inch in an oscillating or circular fashion. Depending on the dimensions of the cell 10 and the relative sizes of the scrapers and electrodes, the minimal movement should generally be less than a few inches, but preferably less. This minimal movement is sufficient to ensure that the entire face of the cathode is scraped to eliminate any chance of a short circuit. The motor 24 is preferably mounted on a shelf 22 adjacent to cell box 20. The motor 24 can be driven periodically to efficiently run the electrowinning process. The scraper 14 ideally rubs directly against dendrite growth 30 to remove the dendrite growth from the plurality of cathodes. Thus, the relative movement of the scraper 14 prevents the bridging of the gap between the anode and cathode. Although dendrites may still be able to pass through the scraper (if it has the plurality holes 19), the dendrite growth 30 breaks lose from the cathode and no longer is able to cause a short circuit. The dendrite growth 30 is knocked lose and eventually falls to the cell box bottom 34 where the dendrite growth can be continuously harvested if desired.

Figure 7:
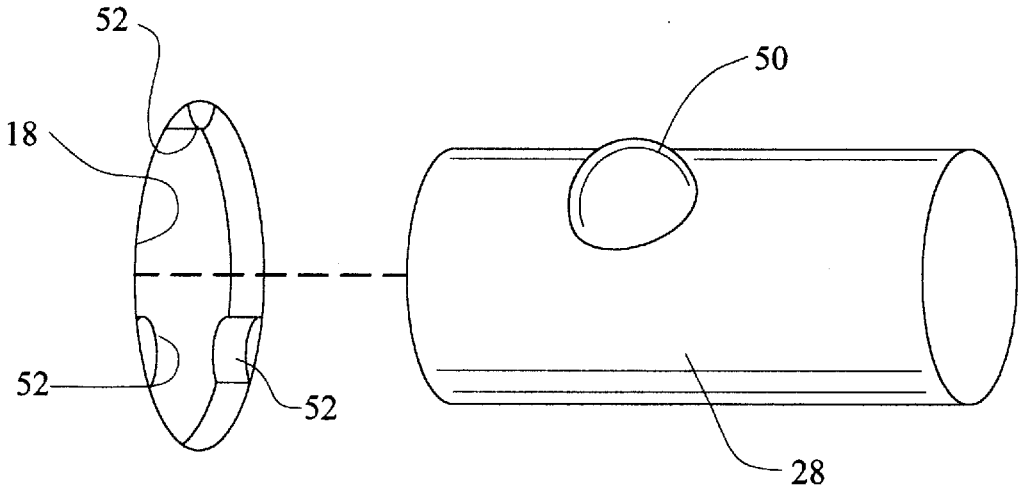
FIG. 7 is a perspective view of a whole within a scraper and corresponding shaft used to move the scraper in accordance with another embodiment of the present invention.

Alternatively, with reference to FIG. 6 and FIG. 7, the scraper 14 could be made to move relative to the electrodes in a variety of other ways as should be understood to be within contemplation of the scope of the claimed invention. For instance, the scraper could be vibrated or moved using detents or bumps 50 in the drive shaft 28 and/or similar detents or bumps 52 in the hole 18 of the scraper as shown in FIG. 7. In this instance, a straight shaft could be used instead of an eccentric shaft, although the combination of an eccentric shaft with detents may prove most effective. In another alternative, the scraper 14 could be moved relative to the electrodes by mere vibration. For example, instead of using a motor to rotate a shaft, a hammer could periodically hit a bar (not shown) that couples the plurality of scrapers together on the top end of the scrapers. It may also be feasible to ultrasonically vibrate the scrapers in a similar fashion.

Although the foregoing invention has been described in some detail by way of illustration and example for purposes of clarity and understanding, it should be apparent to those of ordinary skill in the art in light of the teaching of this invention that certain changes and modifications may be made thereto without departing from the scope or spirit of the claims.

What is claimed is:

1. A method of removing growth from an electrode during an electrowinning process, comprising the steps of:

placing a scraper between a first electrode and a second electrode of opposing polarity and having fairly narrow gaps between the first and second electrode; and moving the scraper a minimal distance relative to at least one of the first and second electrode by oscillating the scraper relative to at least one of the first and second electrode, using one or a combination selected from the group comprising an eccentric shaft, at least one detent in a hole in the scraper, or at least one detent on a shaft coupled to a motor used for moving the scraper.

2. The method of claim 1, wherein the scraper has a surface area larger than a surface area of one of said first and second electrode.

3. The method of claim 1, wherein the step of moving the scraper a minimal distance relative to the electrodes comprises moving the scraper less than one inch relative to one of said first and second electrode.

4. The method of claim 1, wherein the step of moving the scraper comprises the step of moving the scraper by vibration in a small relative motion to at least the first electrode.

5. The method of claim 1, wherein the step of moving the scraper comprises the step of moving the scraper to remove dendrite growth from the first electrode acting as a cathode.

6. An electrolytic cell, comprising:

a plurality of electrodes of opposing polarity; and a scraper placed between each of the plurality of electrodes of opposing polarity, wherein the scraper is adapted to move a minimal distance relative to the plurality of electrodes by using one or a combination selected from the group consisting of an eccentric shaft, at least one detent in a hole in the scraper, or at least one detent on a shaft coupled to a motor used for moving the scraper.

7. The electrolytic cell of claim 6, wherein the scraper has a larger surface area than the surface area of one of the plurality of electrodes.

8. The electrolytic cell of claim 6, wherein the scraper has a plurality of holes to allow for flow of electrolyte within the electrolytic cell.

9. The electrolytic cell of claim 6, wherein the scraper is made from a non-conductive material.

10. An electrolytic cell, comprising a plurality of cathodes interspersed among a plurality of anodes, wherein the plurality of cathodes and plurality of anodes form a plurality of electrodes spaced and suspended in parallel fashion in an electrolyte solution; and a plurality of scrapers, wherein each scraper of the plurality of scrapers is placed between each of the plurality of electrodes in parallel fashion and wherein the scraper is adapted to move a minimal distance relative to the plurality of electrodes using one or a combination selected from the group consisting of an eccentric shaft, at least one detent in a hole in the scraper, or at least one detent on a shaft coupled to a motor used for moving the scraper for periodically moving the scraper.

11. The electrolytic cell of claim 10, wherein the plurality of scrapers is coupled together to move in parallel as a group and wherein the plurality of cathodes and the plurality of anodes have fairly narrow gaps between them.

12. The electrolytic cell of claim 10, wherein each scraper has a larger surface area than the surface area of one of the plurality of electrodes so that the scraper extends beyond the edges of one of the plurality of electrodes.

13. The electrolytic cell of claim 10, wherein each scraper has a plurality of holes to allow for flow of electrolyte within the electrolytic cell.

14. The electrolytic cell of claim 10, wherein the scraper is made from perforated polypropylene.

15. The electrolytic cell of claim 10, wherein the scraper is adapted to rub 2 directly against dendrite growth to remove the dendrite growth from the plurality of cathodes.

* * * * *

UNITED STATES PATENT AND TRADEMARK OFFICE

CERTIFICATE OF CORRECTION

PATENT NO. : 6,503,385 B2
DATED : January 7, 2003
INVENTOR(S) : Chorzempa

It is certified that error appears in the above-identified patent and that said Letters Patent is hereby corrected as shown below:

Column 4,
Line 64, delete "2".

Signed and Sealed this

Twenty-second Day of July, 2003

JAMES E. ROGAN
*Director of the United States Patent and Trademark Office*